US006622796B1

(12) United States Patent
Pietras

(10) Patent No.: US 6,622,796 B1
(45) Date of Patent: Sep. 23, 2003

(54) APPARATUS AND METHOD FOR FACILITATING THE CONNECTION OF TUBULARS USING A TOP DRIVE

(75) Inventor: Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/868,438

(22) PCT Filed: Nov. 29, 1999

(86) PCT No.: PCT/GB99/03944

§ 371 (c)(1),
(2), (4) Date: Sep. 4, 2001

(87) PCT Pub. No.: WO00/39429

PCT Pub. Date: Jul. 6, 2000

(30) Foreign Application Priority Data

Dec. 24, 1998 (GB) ..... 9828669

(51) Int. Cl.[7] ..... E21B 19/00

(52) U.S. Cl. ..... 166/379; 166/85.1; 166/77.51; 175/170

(58) Field of Search ..... 166/378–380, 166/85.1, 117.5, 206, 77.51, 77.52, 162; 175/850, 170, 162

(56) References Cited

U.S. PATENT DOCUMENTS

| | | | | |
|---|---|---|---|---|
| 1,917,135 | A | 7/1933 | Littell | |
| 3,041,901 | A | 7/1962 | Knights | 81/53 |
| 3,193,116 | A | 7/1965 | Kenneday et al. | 214/2.5 |

(List continued on next page.)

FOREIGN PATENT DOCUMENTS

| | | | | |
|---|---|---|---|---|
| EP | 01 62000 | A1 | 11/1985 | E21B/19/16 |
| EP | 0 171 144 | A1 | 2/1986 | E21B/19/06 |
| EP | 0 285 386 | A2 | 10/1988 | E21B/19/16 |
| EP | 0 525 247 | A1 | 2/1993 | E21B/3/02 |
| EP | 0 589 823 | A1 | 3/1994 | E21B/19/06 |
| EP | 0 659 975 | | 6/1995 | E21B/43/08 |
| GB | 2 224 481 | A | 9/1990 | B66C/1/56 |
| GB | 2 275 486 | A | 4/1993 | E21B/37/00 |

(List continued on next page.)

OTHER PUBLICATIONS

LaFleur Petroleum Services, Inc., "Autoseal Circulating Head,"Engineering Manufacturing, 1992, 11 Pages.

Valves Wellhead Equipment Safety Systems, W–K–M Division, ACF Industries, Catalog 80, 1980, 5 Pages.

"Canrig Top Drive Drilling Systems," Harts Petroleum Engineer International, Feb. 1997, 2 Pages.

"The Original Portable Top Drive Drilling System," TESCO Drilling Technology, 1997.

Killalea, Mike, "Portable Top Drives: What's Driving The Market?"IADC, Drilling Contractor, Sep. 1994, 4 Pages.

"500 or 650 ECIS Top Drive," Advanced permanent Magnet Motor Technology, TESCO Drilling Technology, Apr. 1998, 2 Pages.

"500 or 650 HCIS Top Drive," Powerful Hydraulic Compact Top Drive Drilling System, TESCO Drilling Technology, Apr. 1998, 2 Pages.

"Production Information (Sections 1–10)," CANRIG Drilling Technology, Ltd. Sep. 18, 1996.

*Primary Examiner*—Frank Tsay
(74) *Attorney, Agent, or Firm*—Moser, Patterson & Sheridan, L.L.P.

(57) ABSTRACT

An apparatus for facilitating the connection of tubulars using a top drive, the apparatus comprising a supporting member (13) connectable to said top drive (3) characterized in that it further comprises an internal tool (30) for engaging said tubular (7) and an external clamping device (39) for engaging said tubular (7).

27 Claims, 3 Drawing Sheets

U.S. PATENT DOCUMENTS

| | | | | | |
|---|---|---|---|---|---|
| 3,380,528 | A | | 4/1968 | Timmons | 166/14 |
| 3,566,505 | A | | 3/1971 | Martin | 29/200 |
| 3,570,598 | A | | 3/1971 | Johnson | 166/178 |
| 3,635,105 | A | | 1/1972 | Dickman et al. | 81/57.18 |
| 3,691,825 | A | | 9/1972 | Dyer | 73/136 |
| 3,747,675 | A | | 7/1973 | Brown | 166/237 |
| 3,776,320 | A | | 12/1973 | Brown | 173/163 |
| 3,776,991 | A | | 12/1973 | Marcus | 264/89 |
| 3,848,684 | A | | 11/1974 | West | 175/195 |
| 3,857,450 | A | | 12/1974 | Guier | 175/85 |
| 3,913,687 | A | | 10/1975 | Gyongyosi et al. | 175/85 |
| 4,100,968 | A | | 7/1978 | Delano | 166/315 |
| 4,320,915 | A | | 3/1982 | Abbott et al. | 294/96 |
| 4,437,363 | A | | 3/1984 | Haynes | 81/57.18 |
| 4,449,596 | A | * | 5/1984 | Boyadjieff | 175/85 |
| 4,494,424 | A | | 1/1985 | Bates | 81/57.18 |
| 4,529,045 | A | | 7/1985 | Boyadjieff et al. | 173/164 |
| 4,570,706 | A | | 2/1986 | Pugnet | 166/77.5 |
| 4,593,773 | A | | 6/1986 | Skeie | 175/85 |
| 4,604,724 | A | | 8/1986 | Shaginian et al. | 364/478 |
| 4,605,077 | A | | 8/1986 | Boyadjieff | 175/85 |
| 4,625,796 | A | | 12/1986 | Boyadjieff | 166/77.5 |
| 4,649,777 | A | | 3/1987 | Buck | 81/57.19 |
| 4,676,312 | A | | 6/1987 | Mosing et al. | 166/77 |
| 4,683,962 | A | | 8/1987 | True | 173/163 |
| 4,709,599 | A | | 12/1987 | Buck | 81/57.18 |
| 4,742,876 | A | | 5/1988 | Barthelemy et al. | 175/7 |
| 4,759,239 | A | | 7/1988 | Hamilton et al. | 81/57.34 |
| 4,762,187 | A | | 8/1988 | Haney | 175/171 |
| 4,765,401 | A | | 8/1988 | Boyadjieff | 166/77.53 |
| 4,773,689 | A | | 9/1988 | Wolters | 294/88 |
| 4,791,997 | A | | 12/1988 | Krasnov | 175/57 |
| 4,793,422 | A | | 12/1988 | Krasnov | 175/57 |
| 4,800,968 | A | | 1/1989 | Shaw et al. | 175/85 |
| 4,813,493 | A | * | 3/1989 | Shaw et al. | 173/164 |
| 4,836,064 | A | | 6/1989 | Slator | 81/57.18 |
| 4,867,236 | A | | 9/1989 | Haney et al. | 166/77.5 |
| 4,878,546 | A | | 11/1989 | Shaw et al. | 173/163 |
| 4,997,042 | A | | 3/1991 | Jordan et al. | 166/379 |
| 5,009,265 | A | | 4/1991 | Bailey et al. | 166/118 |
| 5,036,927 | A | | 8/1991 | Willis | 175/162 |
| 5,191,939 | A | | 3/1993 | Stokley | 166/379 |
| 5,251,709 | A | | 10/1993 | Richardson | 175/220 |
| 5,255,751 | A | | 10/1993 | Stogner | 175/203 |
| 5,297,833 | A | | 3/1994 | Willis et al. | 294/102.2 |
| 5,351,767 | A | | 10/1994 | Stogner et al. | 175/162 |
| 5,388,651 | A | | 2/1995 | Berry | 175/85 |
| 5,433,279 | A | * | 7/1995 | Tassari et al. | 173/213 |
| 5,501,286 | A | | 3/1996 | Berry | 175/52 |
| 5,503,234 | A | | 4/1996 | Clanton | 175/52 |
| 5,553,672 | A | | 9/1996 | Smith, Jr. et al. | 166/382 |
| 5,577,566 | A | | 11/1996 | Albright et al. | 175/321 |
| 5,584,343 | A | | 12/1996 | Coone | 166/387 |
| 5,645,131 | A | | 7/1997 | Trevisani | 175/171 |
| 5,735,348 | A | | 4/1998 | Hawkins, III | 166/285 |
| 5,791,410 | A | | 8/1998 | Castille et al. | 166/77.1 |
| 5,803,191 | A | * | 9/1998 | Mackintosh | 175/170 |
| 5,836,395 | A | | 11/1998 | Budde | 166/321 |
| 5,909,768 | A | | 6/1999 | Castille et al. | 166/77.1 |
| 5,971,079 | A | | 10/1999 | Mullins | 166/387 |
| 6,000,472 | A | | 12/1999 | Albright et al. | 166/380 |
| 6,056,060 | A | | 5/2000 | Abrahamsen et al. | 166/380 |
| 6,070,500 | A | | 6/2000 | Dlask et al. | 81/57.33 |
| 6,199,641 | B1 | | 3/2001 | Downie et al. | 175/55 |
| 6,309,002 | B1 | | 10/2001 | Bouligny | 294/86.25 |
| 6,311,792 | B1 | | 11/2001 | Scott et al. | 175/162 |
| 6,349,764 | B1 | | 2/2002 | Adams et al. | 166/77.53 |
| 6,360,633 | B2 | | 3/2002 | Pietras | 81/57.34 |
| 6,412,554 | B1 | | 7/2002 | Allen et al. | 166/80.1 |
| 6,431,626 | B1 | | 8/2002 | Bouligny | 294/86.25 |
| 2001/0042625 | A1 | | 11/2001 | Appleton | 166/379 |
| 2002/0134555 | A1 | | 9/2002 | Allen et al. | 166/377 |

FOREIGN PATENT DOCUMENTS

| | | | |
|---|---|---|---|
| GB | 2 357530 A | 6/2001 | E21B/19/07 |
| WO | WO 93/07358 | 4/1993 | E21B/37/00 |
| WO | WO 96/18799 | 6/1996 | E21B/19/06 |
| WO | WO 98/05844 | 2/1998 | E21B/19/16 |
| WO | WO 98/11322 | 3/1998 | E21B/19/16 |
| WO | WO 98/32948 | 7/1998 | E21B/19/16 |
| WO | WO 00/05483 | 3/2000 | E21B/19/16 |
| WO | WO 00/11309 | 3/2000 | E21B/19/16 |
| WO | WO 00/11310 | 3/2000 | E21B/19/16 |
| WO | WO 00/11311 | 3/2000 | E21B/19/16 |
| WO | WO 00/39429 | 7/2000 | E21B/19/16 |
| WO | WO 00/39430 | 7/2000 | E21B/19/16 |

* cited by examiner

APPARATUS AND METHOD FOR FACILITATING THE CONNECTION OF TUBULARS USING A TOP DRIVE

CROSS-REFERENCE TO RELATED APPLICATIONS

This application is the National Stage of International Application No. PCT/GB99/03944, filed Nov. 29, 1999 and published under PCT Article 21(2) in English, and claims priority of United Kingdom Application No. 9828669.3, filed on Dec. 24, 1998. The aforementioned related patent application is herein incorporated by reference.

BACKGROUND OF THE INVENTION

1. Field of the Invention

This invention relates to an apparatus and method for facilitating the connection of tubulars using a top drive and is, more particularly but not exclusively, intended for facilitating the connection of a section or stand of casing to a string of casing.

2. Description of the Related Art

In the construction of oil or gas wells it is usually necessary to line the borehole with a string of tubulars known as casing. Because of the length of the casing required, sections or stands of say two or three sections of casing are progressively added to the string as it is lowered into the well from a drilling platform. In particular, when it is desired to add a section or stand of casing the string is usually restrained from falling into the well by applying the slips of a spider located in the floor of the drilling platform. The new section or stand of casing is then moved from a rack to the well centre above the spider. The threaded pin of the section or stand of casing to be connected is then located over the threaded box of the casing in the well and the connection is made up by rotation therebetween. An elevator is then connected to the top of the new section or stand and the whole casing string lifted slightly to enable the slips of the spider to be released. The whole casing string is then lowered until the top of the section is adjacent the spider whereupon the slips of the spider are re-applied, the elevator disconnected and the process repeated.

It is common practice to use a power tong to torque the connection up to a predetermined torque in order to make the connection. The power tong is located on the platform, either on rails, or hung from a derrick on a chain. However, it has recently been proposed to use a top drive for making such connection.

Because of the high costs associated with the construction of oil and gas wells time is critical and it has been observed by the applicants that the time to connect a tubular to a top drive using existing equipment could be reduced.

There is described an apparatus for facilitating the connection of tubulars using a top drive in co-pending UK Patent Application No. 98 18358.5, which apparatus comprises a body connectable to a top drive, the body comprising at least one gripping element radially displaceable by hydraulic or pneumatic fluid to drivingly engage the tubular. Preferably, the gripping elements are moveable radially outwardly to engage the inside wall of the tubular.

It has been observed that torques of up to 95,000 Nm (70,000 lbs/ft) are required to make-up a joint.

SUMMARY OF THE INVENTION

It has also been observed that the apparatus of the present invention may be used for facilitating rotation of the casing while running the casing down a wellbore.

It has also been observed that a drill bit may be placed on the bottom end of the casing string and used for boring a wellbore. The apparatus of the present invention may be used for facilitating rotation of the casing for boring a wellbore.

According to a first aspect of the invention there is provided an apparatus for facilitating the connection of tubulars using a top drive, the apparatus comprising a supporting member connectable to said top drive characterised in that it further comprises an internal tool for engaging said tubular and an external clamping device for engaging said tubular.

Other features of the first aspect of the present invention are set out in claims 2 to 11.

There is also provided a method for facilitating the connection of tubulars using a top drive, the method comprising the steps of inserting and activating an internal tool for engaging said tubular; rotating said tool and tubular to a low torque, activating an external clamping device for engaging said tubular and rotating said clamping device and said tubular to a high torque.

Preferably, the first torque is sufficient to run a pin on said first tubular into a box and the second torque is sufficient to tighten said connection to its designated value.

According to a second aspect of the invention there is provided an apparatus for facilitating the connection of tubulars, the apparatus comprising a tool for gripping a tubular and at least one piston and cylinder for raising and lowering said tool characterised in that, in use, torque applied to the supporting member is transformed to said tool through said at least one piston and cylinder. Preferably, three piston and cylinders are provided.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

For a better understanding of the present invention, reference will now be made, by way of example, to the accompanying drawings, in which.

DETAILED DESCRIPTION OF THE PREFERRED EMBODIMENT

Figure 1:
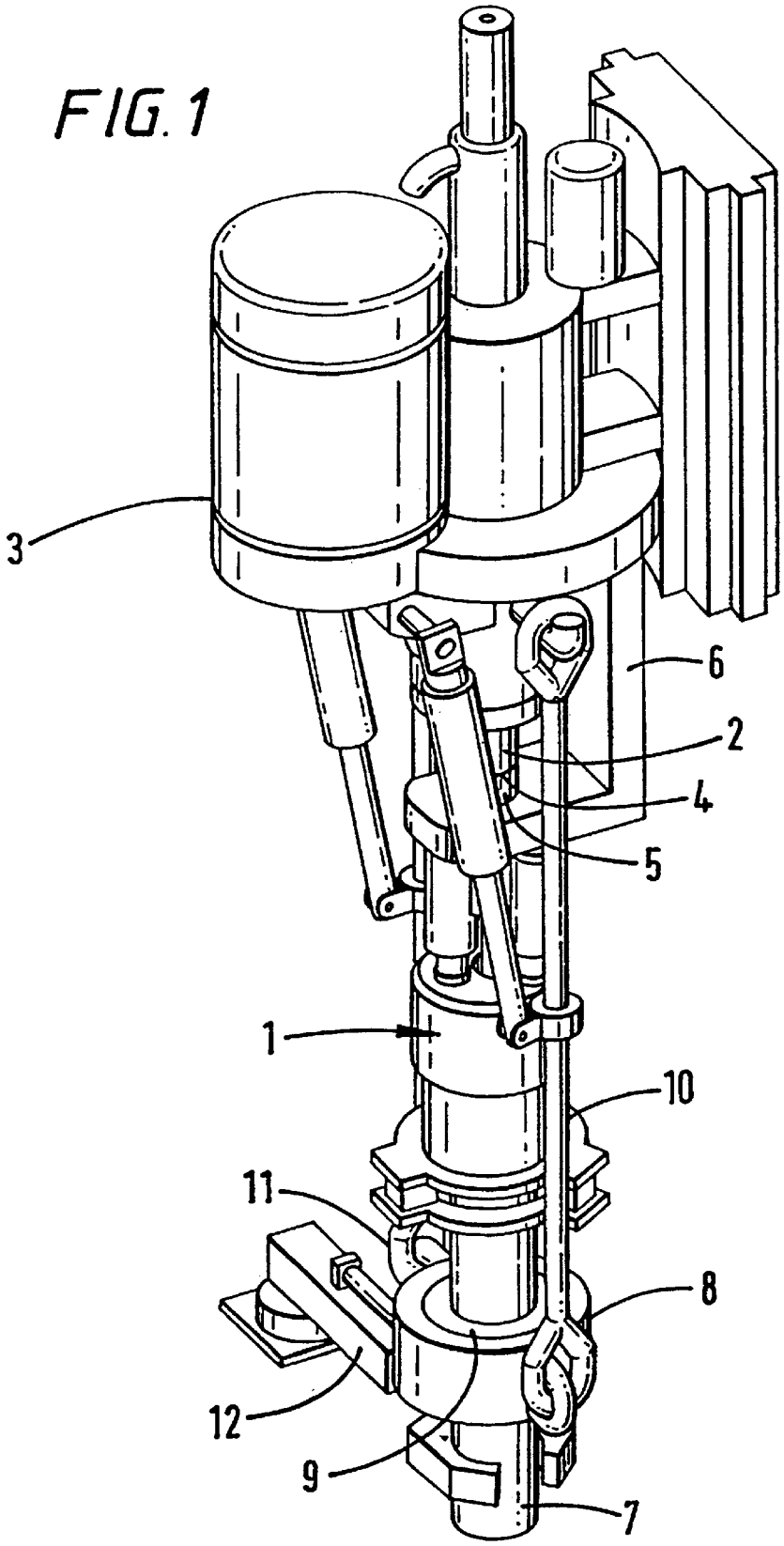
FIG. 1 is a view in perspective of an apparatus according to the invention, the apparatus being shown in use.
Figure 2:
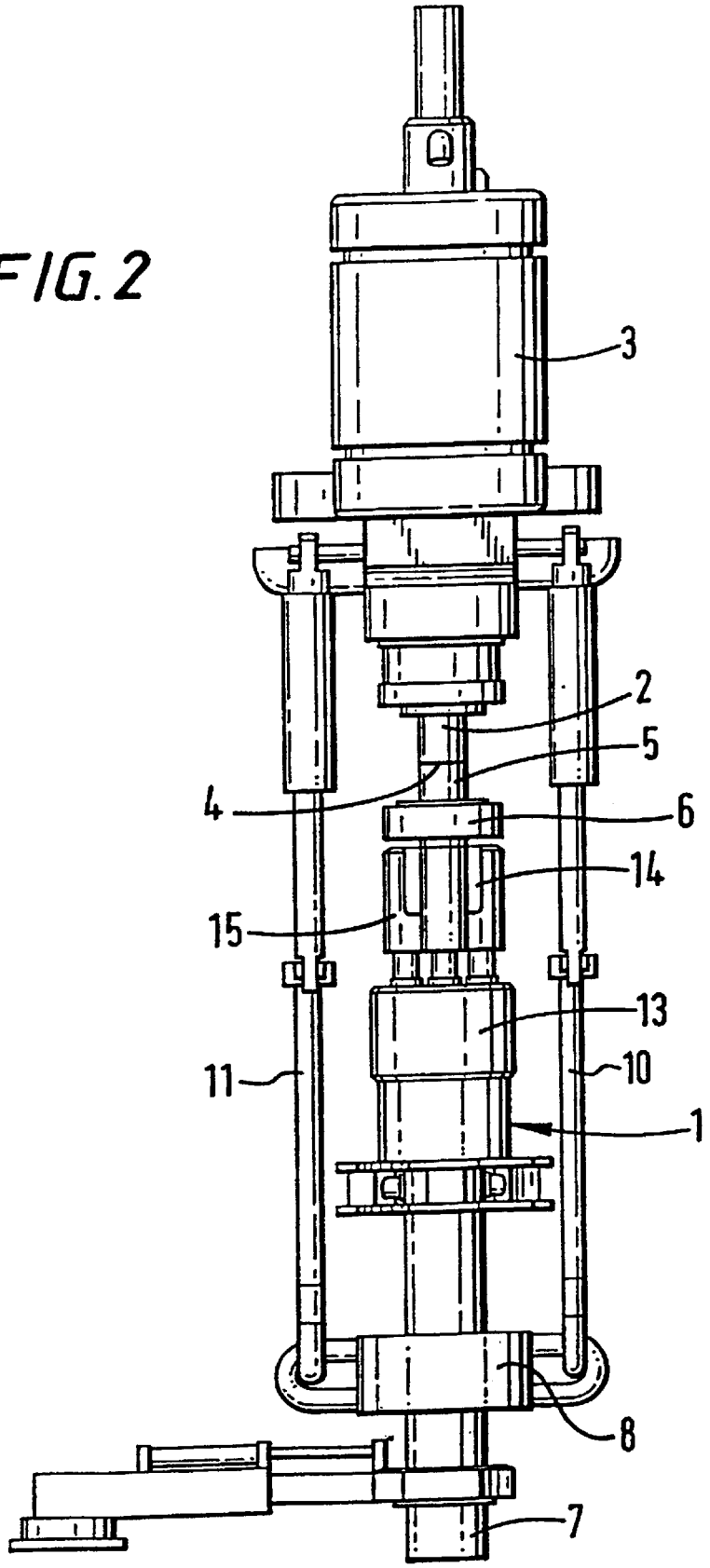
FIG. 2 is a front plan view of the apparatus of FIG. 1, the apparatus being shown in use.
Figure 3:
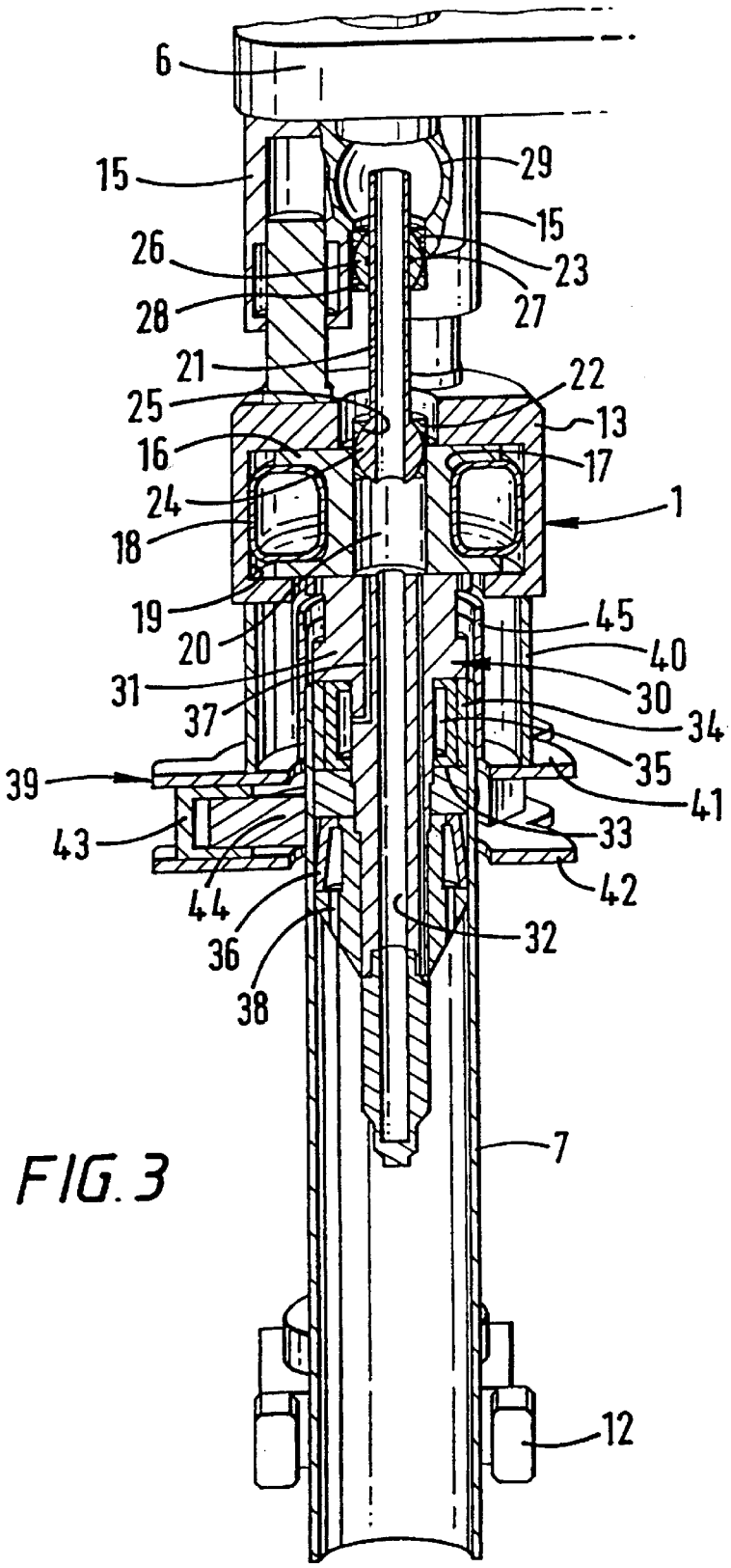
FIG. 3 is an enlarged cross-sectional view of parts of FIG. 1.

Referring to the drawings, there is shown an apparatus for facilitating the connection of tubulars using a top drive. The apparatus is generally identified by reference numeral 1.

The apparatus 1 is shown connected to a rotor 2 of a top drive 3 via connection 4 to a rotor 5 of the apparatus 1. The top drive 3 is located on rails on a derrick of a rig (not shown). A rigid member 6 is fast with a static part of the top drive 3. The rigid member surrounds the rotor 5. The rigid member 6 has a clamp therein which, when required, applies jaws (not shown) to the rotor 5 such that, upon rotation of the rotor 2 of the top drive 3, the apparatus 1 may be connected or disconnected from the top drive 3. When the jaws are released, the rotor 5 may rotate freely within the rigid member 6.

The apparatus 1 is shown with a stand of casing 7 inserted therein. An elevator 8 is shown gripping the stand of casing 7 with the use of gripping elements 9. The elevator 8 is suspended from the top drive 3 on bails 10 and 11. The stand of casing 7 is guided by a pipe handling arm 12.

The apparatus 1 comprises a housing 13 which depends from the rotor 5 via a supporting element 14 and three piston and cylinders 15. The three piston and cylinders 15 allow small vertical movements of the apparatus 1 relative to the top drive 3. The three piston and cylinders 15 may be hydraulically activated or pneumatically activated or using a combination of both pneumatic and hydraulic fluids.

The housing 13 accommodates a hub 16 which is radially and rotationally moveable therein. The hub 16 has a circumferential recess 17 into which an inflatable ring 18 is arranged. The inflatable ring 18 is in frictional engagement with both the hub 16 and an internal wall 19 of the housing 13. The hub 16 has a central bore 20 into which one end of a mud pipe 21 is inserted. The mud pipe 21 is provided for carrying mud to the inside of the tubular 7. The mud pipe 21 is mounted in cylindrical sections 22 and 23 which are attached to the hub 16 and the supporting element 14 respectively. The mud pipe 21 is provided with a lobe 24 formed on the outer surface thereof and is located in a corresponding recess 25 in the cylindrical section 22. A lobe 26 is slidably arranged on the upper end of the mud pipe 21 with an O-ring seal 27 arranged therebetween to inhibit fluid from leaking therebetween. The lobe 26 is located in a corresponding recess 28 in the cylindrical section 23. This arrangement allows a ball and socket type movement between the supporting element 14 and the hub 16 and relative longitudinal movement therebetween. The upper end of the mud pipe 21 is allowed to move freely in a spherical recess 29 in the supporting element 14.

A circulating tool generally identified by reference numeral 30 is fixed to and depends from the hub 16. The circulating tool 30 comprises a cylindrical body 31 which has a central passage 32 therethrough. The cylindrical body 31 has a plurality of recesses 33 thereabout in which gripping elements 34 are located. The gripping elements are provided with recesses 35.

The cylindrical body 31 is also provided with an inflatable sealing ring 36 arranged below the gripping elements 34.

The cylindrical body 31 is provided with a feed passage 37 the upper end of which is connected to a hydraulic fluid supply and at the other end to the recesses 35 in the gripping elements 34. A feed passage 38 connects the inflatable sealing ring 36 with the inside of the tubular 7.

A clamping device 39 depends from the housing 13 on a rigid cylinder 40. The clamping device 39 comprises two rigid plates 41 and 42 between which is arranged three hydraulic pistons 43 spaced at 120° to each other. The hydraulic pistons 43 are provided with gripping elements 44 for engaging with the tubular 7.

In use, the apparatus 1 is fitted to the rotor 2 of a top drive 3 via the rotor 5 of the apparatus 1. When it is desired to connect a stand of tubulars such as casing to a string of casing already lowered into a wellbore and suspended from a spider in the rig floor (not shown), the following steps are performed.

A stand of casing is moved from a storage area to the well centre, and is gripped by the pipe handling arm 12. The pipe handling arm 12, if necessary, moves the stand of casing to a position where the apparatus 1 may be lowered onto the top of the stand of casing. The apparatus 1 is lowered with the top drive 3 on the rails on the derrick of the rig. As the apparatus 1 is lowered, the circulating tool 30 inserts itself inside the stand of casing and the clamping device 39 passes over the box 45 of the casing 7.

The gripping elements 34 are moved radially outwardly by the hydraulic fluid pressure build up through feed passage 37 and into recess 35. The gripping elements 34 engage with the internal wall of the casing 7. It should be noted that the weight of the stand of casing may now be taken by the gripping elements 34. The pipe handling arm 12 can now move the stand of casing into exact alignment with the box of the casing string protruding above the spider in the rig floor. This step is necessary due to the stands of casing being slightly bent. As the stand of casing 7 moves, the circulating tool 30 moves with the casing 7. The pneumatic fluid in the inflatable ring 18 allows relative movement between the stationary top drive 3 and circulating tool and hence the casing 7. Once aligned, the stand of casing is lowered ("stabbed") into the box of the casing string by activation of piston and cylinders 15. Low torque rotation of the stand of casing now begins by rotation of the top drive rotor 2. It should be noted that the inflatable ring 18 helps accommodate non-linearity in the casing 7 since it allows the top of the casing 7 to float with respect to the longitudinal axis of the top drive 3 whilst being rotated to engage the pin of the casing 7 in the box of the casing string held in the spider in the rig floor. The low torque is transferred from the rotor 2 of the top drive through the piston and cylinders 15, through the housing 13 and via the inflatable ring 18 to the circulating tool 30 and hence to the stand of casing 7 via the gripping elements 34. The threaded pin of the stand of casing 7 is now partially made up with the threaded box of the casing string. The pipe handling arm 12 may now be removed from the casing 7 and swung into an inoperative position. The three piston and cylinders 43 of the clamping device are now activated evenly which moves the top of the stand of casing 7 and the circulating tool 30 into exact alignment with the top drive. The top drive may now be used to complete make-up by rotating the stand of casing typically up to 95,000 Nm (70,000 lb/ft) of torque. The high torque is transferred from the top drive 3 through piston and cylinders 15 through the housing 13, the rigid cylinder 40 and the clamping device 39 and hence to the stand of casing 7.

The spider may be used to hold the casing string 7 against rotation while this operation is carried out.

The elevator 8 may now be swung around the top of the casing 7. Circulation may now take place. Any pressure build up in the casing 7 would force the inflatable sealing ring 36 out and into engagement with the casing wall due to pressure build up through the feed passage 38. Circulating fluid may be pumped into the casing string through mud pipe 19, central bore 20 and central passage 32.

The spider may be released allowing the elevator 8 to take the weight of the casing string. The elevator 8 may lower the casing string into the wellbore. During lowering the top drive 3 may continue to rotate the apparatus 1 and hence rotate the casing string at up to 95,000 Nm (70,000 lbs/ft) of torque, if required.

The apparatus 1 may be removed by deactivating the piston and cylinders 43 of the clamping device 39, the gripping elements 34 of the circulating tool 30, deflating the inflatable sealing ring 36 and lifting the apparatus 1 by raising the top drive 3.

A reverse sequence may be used to disconnect stands or single pieces of casing from a casing string.

It is envisaged that various modifications or variations may be made to the above described embodiment. In particular, the inflatable ring 18 may contain pneumatic fluid and be sealed. Alternatively, the inflatable ring 18 may be provided with a pneumatic supply line for controlling the pressure of the pneumatic fluid therein, for example for lowering the pressure when aligning the casing. The inflatable ring 18 may contain hydraulic fluid and be provided with a waste gate or a supply line for controlling the quantity of hydraulic fluid therein. A combination of both hydraulic and pneumatic fluids may be used preferably using hydraulic fluid in the inflatable ring and pneumatic bellows.

The inflatable ring may be a vehicle tyre.

It is envisaged that in certain embodiments the apparatus 1 may not be directly linked to the top drive 3. In particular, a motor, advantageously a hydraulic motor, may be inserted between the top drive 3 and the apparatus 1 for providing accurate speed of rotation and control for making up the casing.

It is envisaged that the apparatus 1 could be used for rotating the casing while lowering the casing. Reciprocation of the casing may also be provided simultaneously by raising and lowering the elevator.

It is envisaged that the casing string may be provided with a drilling bit as its lower end. The apparatus 1 may be used, with the clamping device 39 actuated, to rotate the casing and hence the drill bit, for drilling a wellbore.

It is conceivable that the clamping device 39 could be dispensed with and the entire torque from the top drive transmitted through the inflatable ring 18, particularly if highly pressurized with hydraulic fluid at the time it is desired to transmit high torque.

It is also envisaged that any suitable mechanism and method of actuation could be used for external clamping. For example, the mechanism could comprise cam surfaces with rough material thereon. The method of actuation could be mechanical, electrical, pneumatic, hydraulic or chemical. A design from a power tong may be suitable for this purpose.

While the foregoing is directed to embodiments of the present invention, other and further embodiments of the invention may be devised without departing from the basic scope thereof, and the scope thereof is determined by the claims that follow.

What is claimed is:

1. An apparatus for facilitating the connection of tubulars using a top drive, the apparatus comprising a tool (30, 39) for gripping a tubular and at least one piston and cylinder (15) for raising and lowering said tool characterised in that in use, all the rotational force applied by said top drive is transferred to said tool (30, 39) through said at least one piston and cylinder (15).

2. An apparatus as claimed in claim 1, wherein said apparatus comprises three piston and cylinders (15).

3. An apparatus for facilitating the connection of a first tubular to a second tubular using a top drive, comprising:

a supporting member connectable to the top drive;

a first clamp assembly having a first gripping member for engaging an inner surface of the first tubular and transferring a first torque to the first tubular; and a second clamp assembly having a second gripping member for engaging an outer surface of the first tubular and transferring a second torque to the first tubular, wherein the first and second clamp assemblies are moveable with respect to each other.

4. The apparatus as claimed in claim 3, wherein the first clamp assembly includes means for supporting a weight of the first tubular.

5. The apparatus as claimed in claim 3, wherein the first clamp assembly is actuable by a fluid.

6. The apparatus as claimed in claim 3, wherein the second clamp assembly is actuable by a fluid.

7. The apparatus as claimed in claim 6, wherein the fluid is selected from the group consisting of pneumatic, hydraulic, and combinations thereof.

8. The apparatus as claimed in claim 3, wherein the first clamp assembly comprises a sealing element for sealing an annulus between the first clamp assembly and the first tubular to facilitate circulation in the first tubular.

9. The apparatus as claimed in claim 8, wherein the first clamp assembly further comprises a feed line which extends from the sealing element to an opening in the first clamp assembly downstream of the sealing element, wherein the sealing element is arranged to be activated by pressure build up below the sealing element.

10. The apparatus as claimed in claim 3, further comprising a flexible membrane arranged between the first clamp assembly and the second clamp assembly, the flexible membrane having a fluid.

11. A method for facilitating the connection of tubulars using a top drive, the method comprising the steps of:

inserting a first clamp assembly to engage a first tubular;

rotating the first clamp assembly and the first tubular to threadedly engage the first tubular with the second tubular at a first torque;

engaging the first tubular with a second clamp assembly; and actuating the second clamp assembly to a apply second torque to tighten the engagement between the first tubular and the second tubular.

12. A method for facilitating the connection of tubulars using a top drive, comprising:

engaging an inner surface of a first tubular with a first clamp assembly;

rotating the first clamp assembly and the first tubular at a first torque to threadedly engage the first tubular with a second tubular;

engaging an outer surface of the first tubular with a second clamp assembly; and rotating the second clamp assembly at a second torque to further engage the first tubular with the second tubular.

13. An apparatus for use with a top drive to connect a first tubular to a second tubular, comprising:

a housing;

a hub disposed in the housing, the hub radially movable therein;

a circulating tool connected to the hub; and a first clamp assembly connected to the housing.

14. The apparatus of claim 13, further comprising a second clamp assembly operatively connected to the circulating tool.

15. The apparatus of claim 14, wherein the second clamp assembly is adapted to engage an inner surface of the first tubular.

16. The apparatus of claim 14, wherein the first clamp assembly is adapted to engage an outer surface of the first tubular.

17. The apparatus of claim 13, further comprising a supporting element for connecting the housing to the top drive.

18. The apparatus of claim 17, wherein the hub is axially movable relative to the supporting element.

19. The apparatus of claim 18, further comprising a conveying tubular member insertable into the first tubular.

20. The apparatus of claim 19, wherein the conveying tubular member is operatively connected between the hub and the supporting element.

21. The apparatus of claim 13, wherein the first clamp assembly comprises one or more piston and cylinder assemblies.

22. The apparatus of claim 21, wherein actuating the one or more piston and cylinder assemblies aligns the circulating tool with the top drive.

23. The apparatus of claim 13, further comprising an inflatable member disposed between the hub and the housing.

24. The apparatus of claim 23, wherein the inflatable member is actuated by a fluid selected from the group consisting of pneumatic, hydraulic, and combinations thereof.

25. The apparatus of claim 23, wherein the inflatable member allows relative movement between the top drive and the circulating tool.

26. The apparatus of claim 23, wherein a torque applied to the housing is transferred from the housing to the circulating tool via the inflatable member.

27. The apparatus of claim 13, wherein a torque applied to the housing is transferred from the housing to the first clamp assembly.

* * * * *